US008347664B2

(12) United States Patent
Bishir, Jr. et al.

(10) Patent No.: US 8,347,664 B2
(45) **Date of Patent: *Jan. 8, 2013**

(54) ADJUSTABLE MOLDED ARCHERY LOCK

(75) Inventors: Jerry R. Bishir, Jr., Lagro, IN (US); Joshua W. Butcher, Wabash, IN (US); Glenn A. Butcher, Wabash, IN (US)

(73) Assignee: Acu-Archery, LLC, Wabash, IN (US)

( * ) Notice: Subject to any disclaimer, the term of this patent is extended or adjusted under 35 U.S.C. 154(b) by 69 days.

This patent is subject to a terminal disclaimer.

(21) Appl. No.: 12/720,358

(22) Filed: Mar. 9, 2010

(65) Prior Publication Data

US 2010/0269551 A1 Oct. 28, 2010

Related U.S. Application Data

(63) Continuation-in-part of application No. 12/429,820, filed on Apr. 24, 2009.

(51) Int. Cl.
*E05B 73/00* (2006.01)
*F41B 5/00* (2006.01)

(52) U.S. Cl. ..... 70/58; 70/14; 70/26; 70/39; 70/61; 124/86

(58) Field of Classification Search ..... 70/14, 15, 70/16, 18, 19, 26, 39, 57, 58, 61; 124/25.6, 124/35.2, 86

See application file for complete search history.

(56) References Cited

U.S. PATENT DOCUMENTS

| | | | | | |
|---|---|---|---|---|---|
| 596,237 | A * | 12/1897 | Damon | 70/18 |
| 3,805,564 | A * | 4/1974 | Velardo | 70/18 |
| 5,412,959 | A * | 5/1995 | Bentley | 70/30 |
| 5,535,605 | A * | 7/1996 | Werner | 70/14 |
| 5,687,701 | A * | 11/1997 | Henry | 70/18 |
| 5,901,586 | A * | 5/1999 | Hale | 70/18 |
| 6,161,402 | A * | 12/2000 | Moore | 70/14 |
| 6,269,575 | B1 * | 8/2001 | Chang | 42/70.07 |
| 6,330,815 | B1 * | 12/2001 | Duncan | 70/58 |
| 6,382,000 | B1 * | 5/2002 | Horton | 70/163 |
| 6,385,889 | B1 * | 5/2002 | Zaharek | 42/70.11 |
| 6,474,238 | B1 * | 11/2002 | Weinraub | 42/70.07 |
| 6,694,781 | B1 * | 2/2004 | Li | 70/14 |
| 6,722,071 | B1 * | 4/2004 | Lin | 42/70.07 |
| 7,121,124 | B1 * | 10/2006 | Whinery | 70/38 C |
| 2006/0112605 | A1 * | 6/2006 | Sopko | 42/70.11 |
| 2010/0300992 | A1 * | 12/2010 | Surma et al. | 70/14 |

* cited by examiner

*Primary Examiner* — Christopher Boswell

(74) *Attorney, Agent, or Firm* — Gerald E. Helget; Nelson R. Capes; Briggs and Morgan, P.A.

(57) ABSTRACT

An adjustable archery bow lock for an archery bow with bow strings, or a limb with a cam or a pulley, includes a locking first frame with first and second rod receiving apertures there through. A lock mechanism is on the first frame with a moveable and securable locking index pin. A parallel second frame has first and second rods that are adapted to capture and immobilize the bow strings, or the cam or pulley with the limb. The rods pass through the receiving apertures. One of the rods has a series of aligned indentations, teeth or serrations. The rods are secured to the first frame with the locking index pin secured into one of the indentations or between the teeth or serrations to prevent drawing or firing of the bow.

6 Claims, 9 Drawing Sheets

ADJUSTABLE MOLDED ARCHERY LOCK

CROSS-REFERENCE TO RELATED APPLICATION

The present application is a continuation-in-part of and claims priority of U.S. patent application Ser. No. 12/429,820 filed Apr. 24, 2009.

BACKGROUND OF THE INVENTION

The present invention relates to locking archery bows, and more particularly, to adjustable archery bow lock to prevent dry firing or otherwise unwanted firing of a bow as to not cause damage to the bow or injury to a person.

FIG. 1 illustrates an archery bow 10 drawn ready to be shot or fired. The vertical bow string shown in dash lines 40*a* illustrates the resting state of the archery bow 10. A compound bow 10 has a riser or frame 20 and a bow string 30. The riser 20 includes a lower portion 22 with a limb 22*a*, an upper portion 24 with a limb 24*a*, and a handle portion 25 with a grip. The compound bow 10 has a pulley or cam 42 at the end of the lower portion 22*a* and a pulley or cam 44 at the end of the upper portion 24*a*. The bow string 30 extends between the cam 42 and cam 44. The cams 42, 44 provide a mechanical advantage to the archer when drawing the bowstring 30.

The bowstring 30 includes at least two sections 40*a*, 40*b* extending between the cams 42, 44. Bowstring section 40*a* is the section on which an arrow 50 is knocked. On some bows, bow string sections 40*b* are referred to as a cable. Mounted on the riser 20 above the shelf 35 of the bow 10 is an arrow rest 36, which supports an arrow 50 while the archer is preparing to shoot. Some compound bows 10 also have a cable guide 52 and a cable slide 54.

Archery Bows are available for inspection by archers and consumers at retail, archery shooting lanes designed for practice shooting and at outdoor trade shows. Unlike guns, archery bows are readily available for any person to pick up at home or off a rack and inspect the bow. Many bows are designed with significant "let off" representing a significant amount of poundage reduction to hold the bow in the firing position after it is fully drawn. Many bows have design letups between 20 and 40%. Naturally, people are not given arrows during their inspection of new and used archery bows. Consequently, many people attempt to draw the bow back towards "wall" position without an arrow ready for firing to feel the let off.

A fully drawn bow without an arrow in place to be fired is potentially very hazardous to the individual who has drawn the bow back and similarly could be very destructive to the bow itself if the testing person releases or "dry fires" the bow, even if accidentally. Firing or releasing an archery bow without an arrow causes enough shock and vibration that the bow may actually break apart or "blow up" with the limb portions 22*a* and 24*a* actually delaminating causing bow parts as enumerated above to blow up, break apart and to go flying in all different directions causing potential significant harm to bystanders and the person inspecting the bow.

There is a significant need for an adjustable archery bow lock that will secure the archery bow to be inspected into a steady resting state not permitting the bow to be drawn which could possibly result in a dry fire and damage the bow as well as hurt people.

SUMMARY OF THE INVENTION

An adjustable archery bow lock for an archery bow with bow strings, or a limb with a cam or a pulley, includes a locking first frame with first and second rod receiving apertures there through. A lock mechanism is on the first frame with a moveable and securable locking index pin. A parallel second frame has first and second rods that are adapted to capture and immobilize the bow strings, or the cam or pulley with the limb. The rods pass through the receiving apertures. One of the rods has a series of aligned indentations, teeth or serrations. The rods are secured to the first frame with the locking index pin secured into one of the indentations or between the teeth or serrations to prevent drawing or firing of the bow.

The principal object and advantage of the present invention is that the adjustable archery bow lock provides absolute safety to people who inspect compound archery bows at home, the point of sale or at a demonstration shooting lane. The archer simply cannot draw the bow string to a firing position as the bow strings, or cam with the limb, are completely immobilized by the lock.

Another object in advantage of the present invention is the prevention of "dry firing" or the release of an archery bowstring without a loaded arrow which results in significant shock to the bow which may cause the bow to literally explode with the limbs delaminating in parts dangerously flying about rendering the bow completely destroyed.

Another object in advantage of the present invention is that the archery bow lock is adjustable as to secure the lock to the bow about the bow strings, or the limb and pulley, of any of a variety of compound bows.

Another object in advantage of the present invention is that the archery bow lock, when securing the strings, is also supported by the cable guide.

Another object and advantage of the archery bow lock is that it provides an anchor or gripping ring suitable for a chain or cable to prevent theft of the archery bow from its point of sale or display.

DETAILED DESCRIPTION OF THE INVENTION

Figure 1:
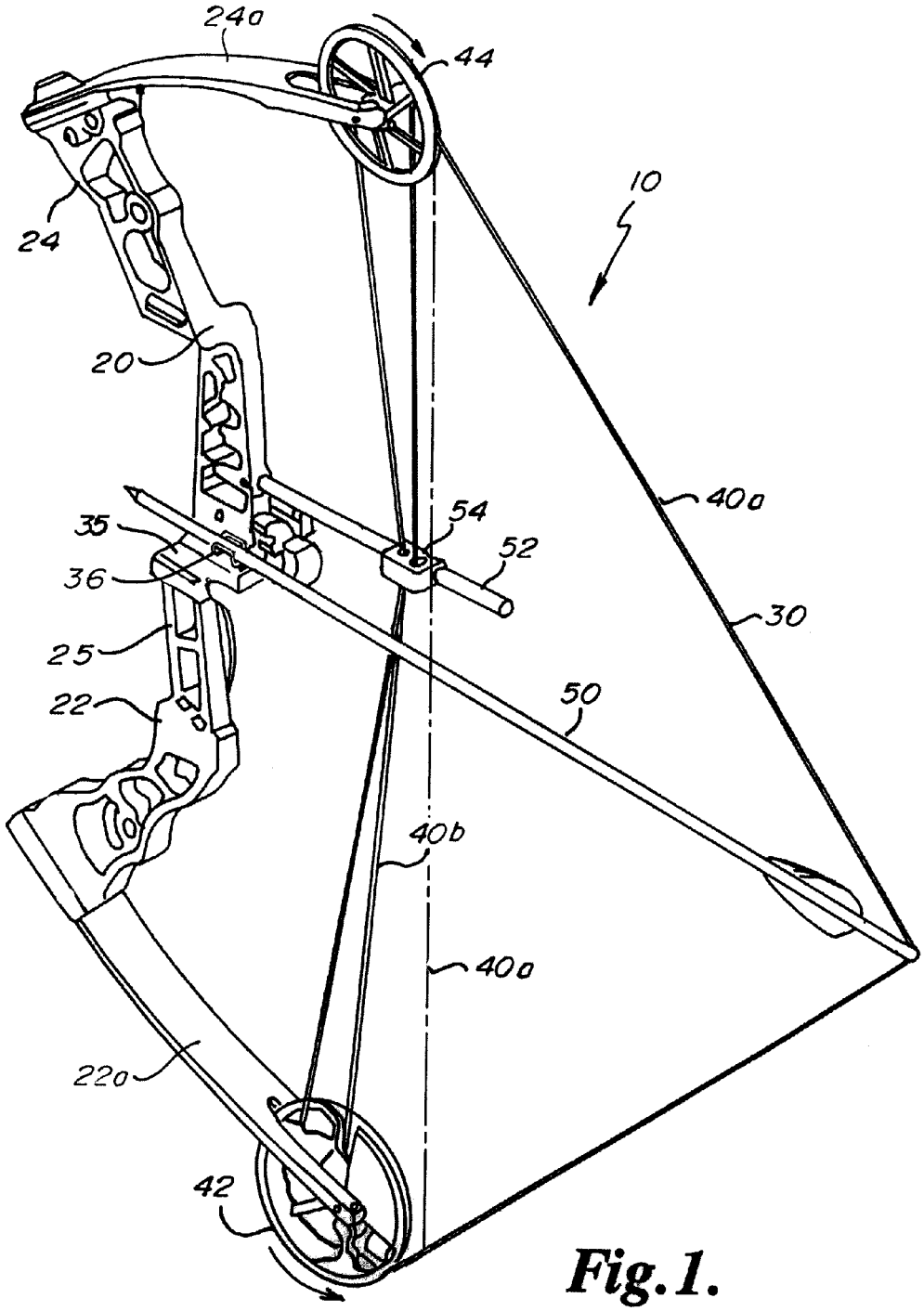
Fig. 1. (PRIOR ART)
FIG. 1 is a prior art perspective view of an archery bow drawn for firing an arrow.
Figure 2:
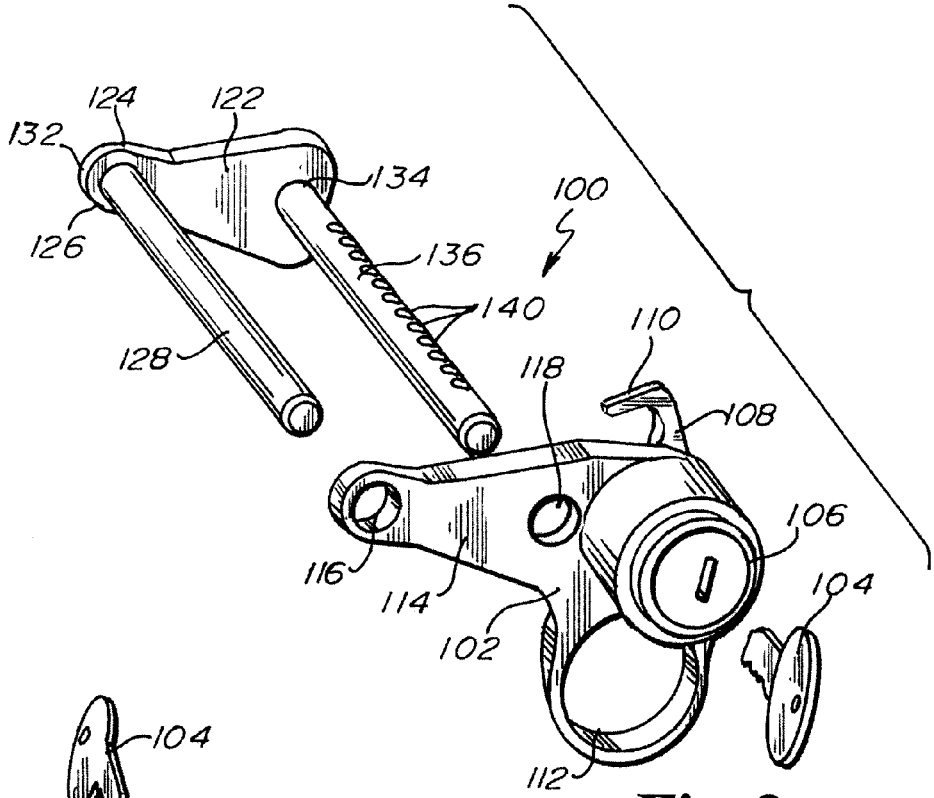
FIG. 2 is an exploded view of the archery bow lock of the present invention.
Figure 3:
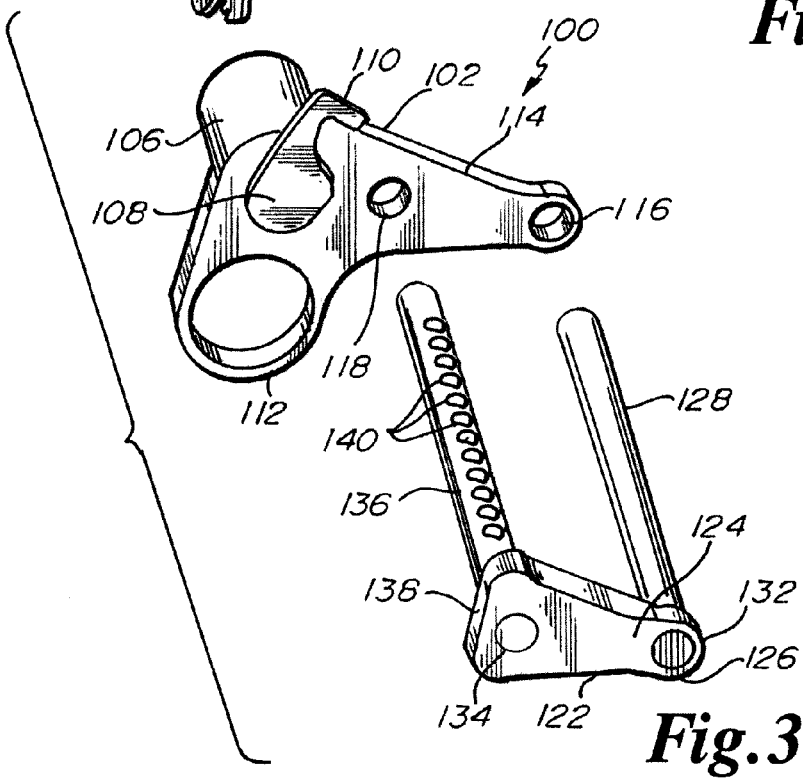
FIG. 3 is an exploded view of the present invention taken from the opposite side of FIG. 2.
Figure 4:
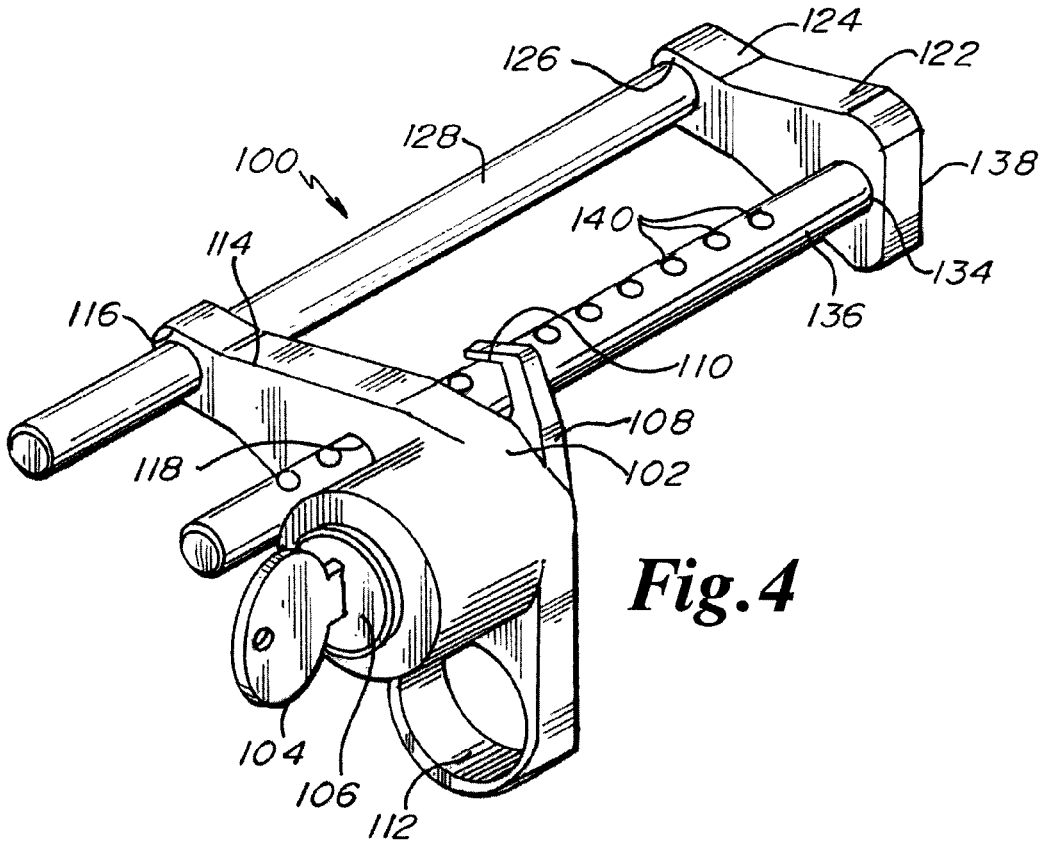
FIG. 4 is a front perspective view of the archery bow lock assembled in its unlocked condition.
Figure 5:
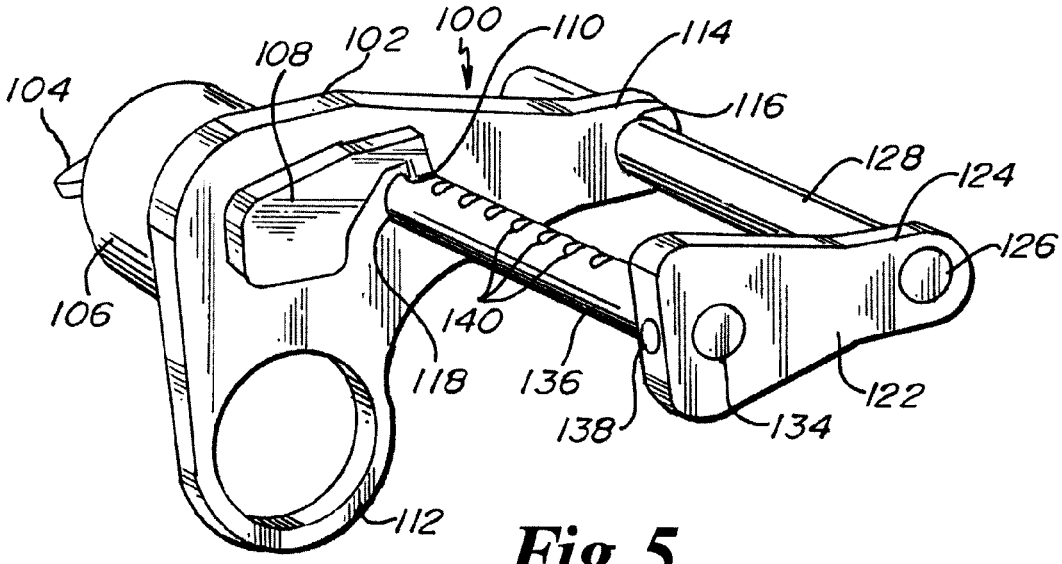
FIG. 5 is a reverse perspective view of the assembled archery bow lock in its locked condition.
Figure 6:
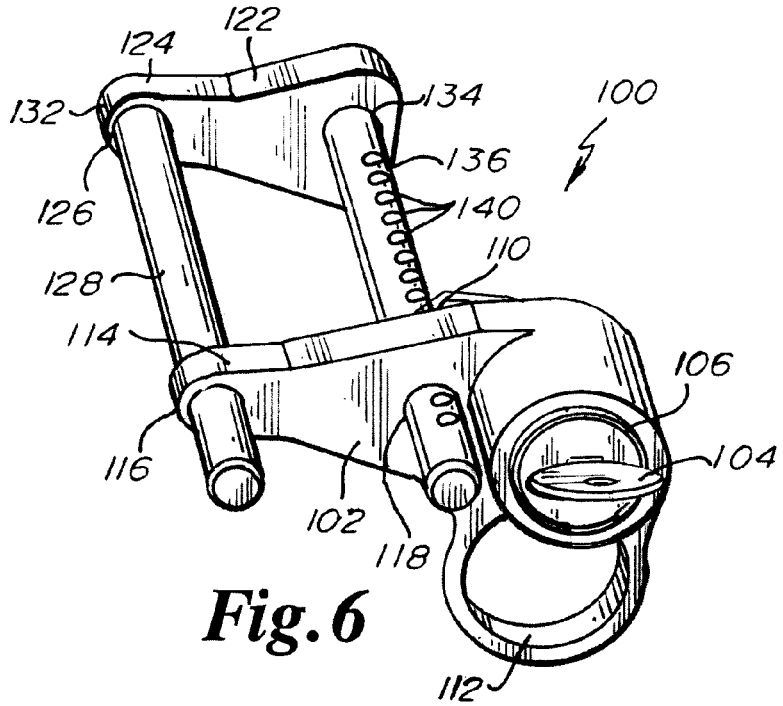
FIG. 6 is a front perspective view of the archery bow lock in its locked condition with a key.

Referring to FIGS. 2 through 6, the adjustable archery bow lock 100 of the present invention may be appreciated. The lock 100 is comprised of a locking first frame 102 wherein a key 104 may be used to operate key lock mechanism 106 which operates rotating latch 108 with indexing pin 110.

Another object and advantage of the archery bow lock of the present invention is that it suitably may be made out of three molded plastic pieces in a very economical arrangement.

Another object and advantage of the present invention is that it suitably works with all compound bows as well as cross bows.

An anchor or gripping ring 112 may be used for interlocking many archery bows together with a chain and is also suitable for supporting the lock 100 by way of ring 112 encompassing the cable guide 52. First frame 102 has an extension 114 whereat is located first rod aperture 116 and space therefrom is second rod aperture 118. A second parallel frame 122 is generally u-shaped and to be oriented generally parallel to the first frame. Second, frame 122 also has a frame extension 124 whereat is located first rod aperture 126 which supports first rod 128 therein and is secured thereat with set screw 132. Spaced inwardly from the first rod aperture 126 is second rode aperture 134 which supports second parallel rod 136 secured thereat by set screw 138. The second parallel rod 136 has a series of aligned indentations 140 for interlocking with the indexing pin 110 of the locking first frame 102.

It can now be appreciated that the adjustable archery bow lock 100 is generally in two pieces comprised of first locking frame 102 and second parallel frame 122. First and second rods 128 and 136 are aligned with the apertures 116 and 118 of the locking first frame respectively. The first frame 102 and second frame 122 may then telescope toward away from each other to the desired distance for locking. Thereafter, the key 104 is rotated to actuate the key lock mechanism 106 to rotate latch 108 and secure indexing pin 110 into one of the indentations 144. Disassembly of the lock is handled in the reverse order with rotation of the key 108 disengaging the index pin 110 with the indentation and separating the first frame 102 from the second frame.

Figure 7:
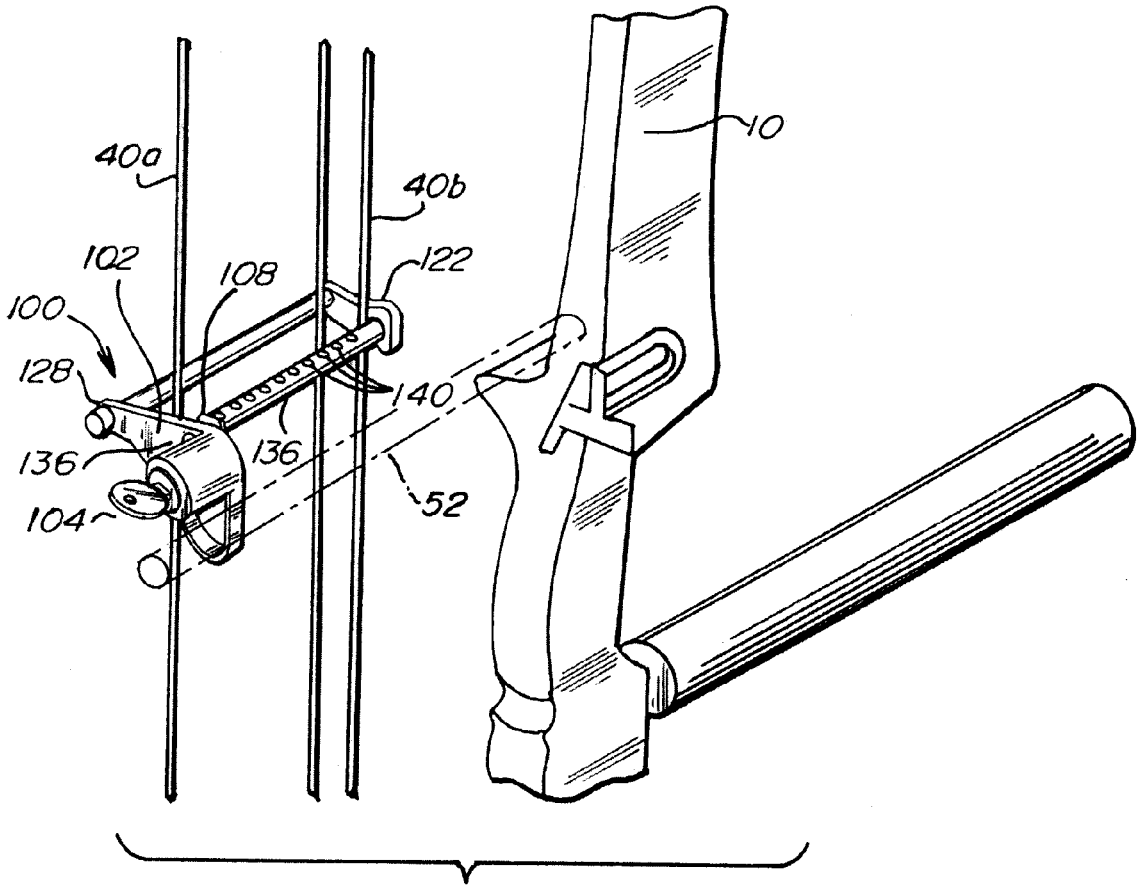
FIG. 7 is a broken away view of an archery bow with the adjustable archery bow lock secured about the bow strings and cable guide.

Referring to FIG. 7, the adjustable archery bow lock 100 is secured about the bow strings 30, 40*a* and 40*b* and held thereat by the anchor ring 112 being indexed about the cable guide 52. The key 104 has been turned and the indexing pin 110 is secured within one of the aligned indentations 140. The key 104 may simply be removed. In this condition, a consumer or archer cannot draw the not arrow portion 40A of the bow sting 30 to test the bow and possibly mistakenly dry fire the bow.

Figure 8:
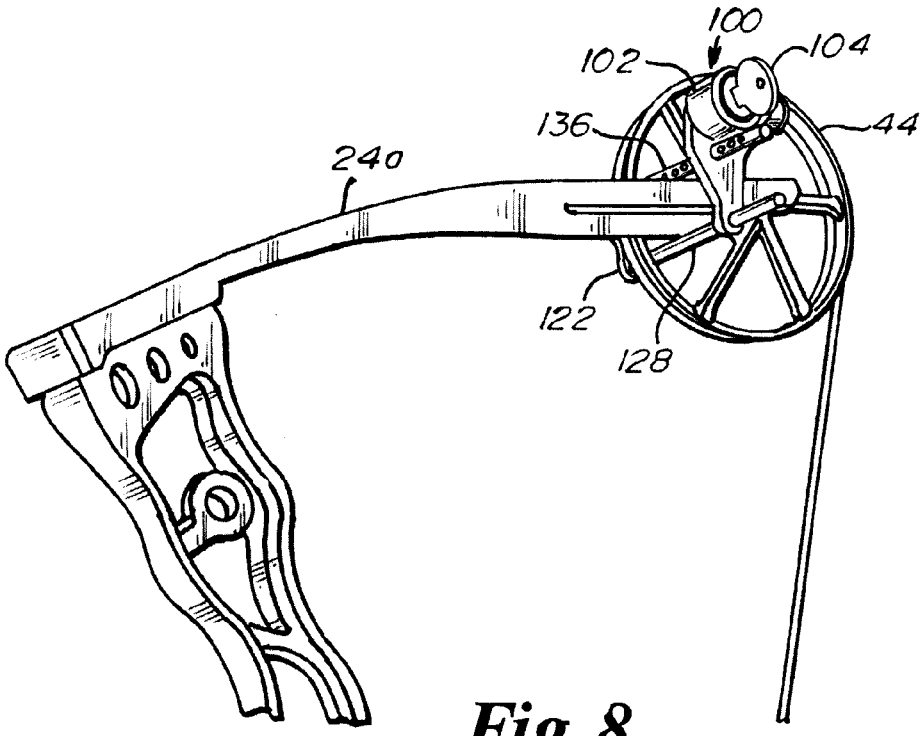
FIG. 8 is a partially broken away view of the adjusted archery bow lock secured about the limb and cam of the bow.

Referring to FIG. 8, the adjustable archery bow lock 100 has the second frame 122 with first and second rods 128 and 136 passing through the upper cam or pulley 42 while also capturing the upper portion of the limb 24*a* to prevent any rotation of the cam or pulley 42 thereby preventing the arrow nock portion 40*a* of the bow string 30 to be drawn back by an archer or a consumer. With this method of usage, it can be appreciated that the first locking frame 102 and second parallel frame 122 are substantially closer together to securely lock the bow 10.

Figure 9:
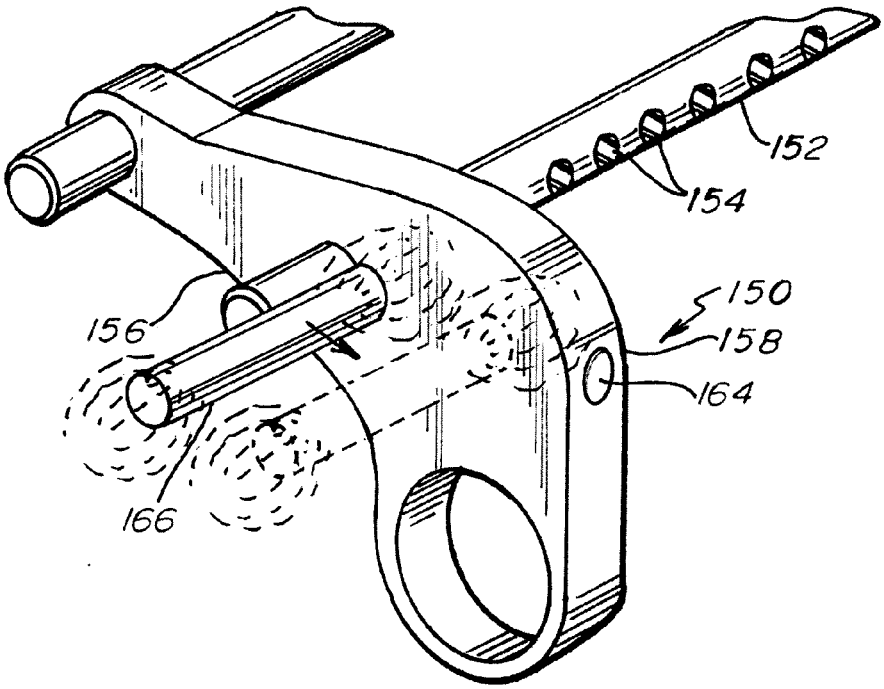
FIG. 9 is a perspective view of another embodiment of the present invention wherein the lock is open and closed with a magnet.
Figure 10:
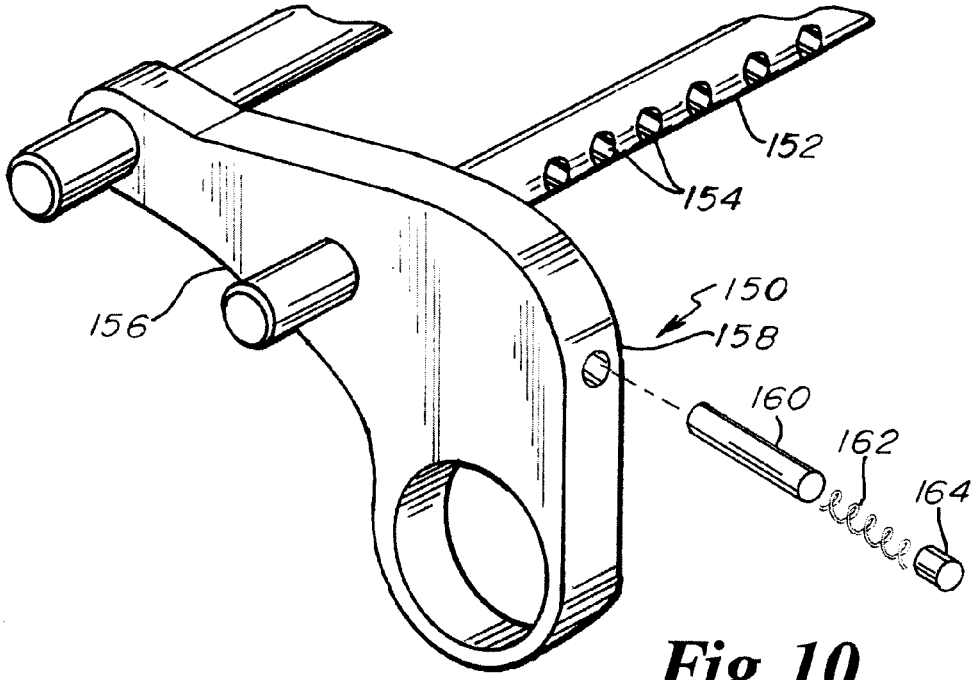
FIG. 10 is an exploded view of the second embodiment of present invention.
Figure 11:
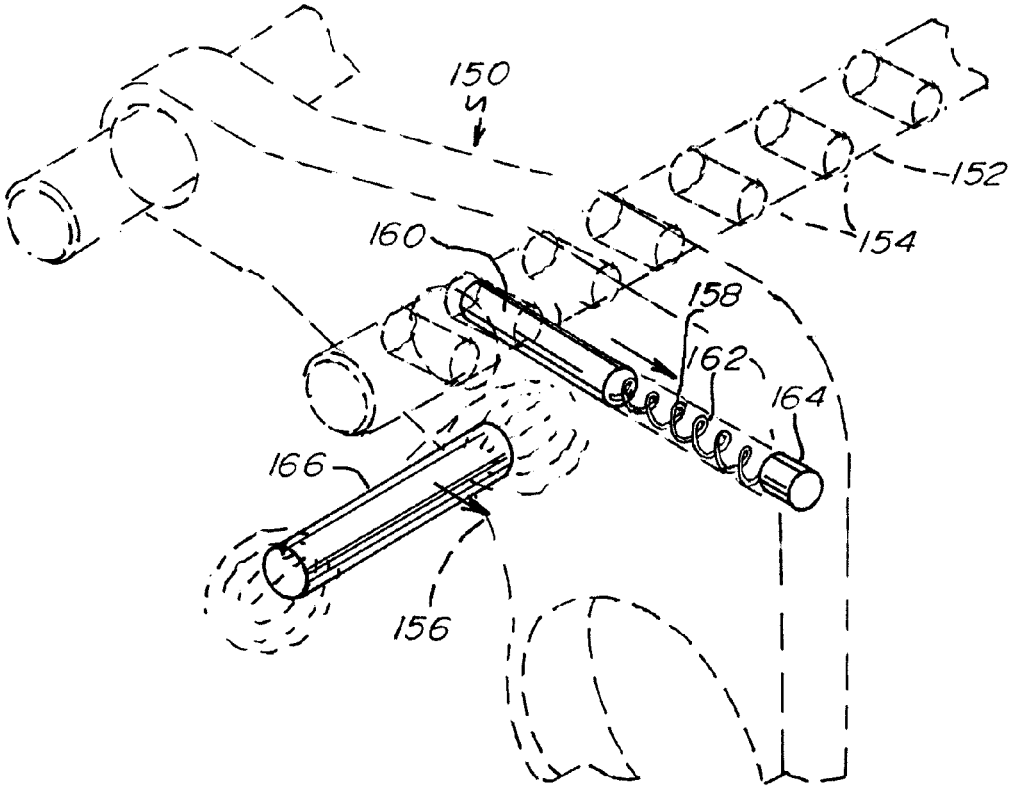
FIG. 11 is a phantom view of the assembly of the second embodiment of the invention.

Referring to FIGS. 9 through 11, the second embodiment of the adjustable archery bow lock 150 may be appreciated. The lock 150 has its second parallel rod 152 with aligned holes 154 passing there through. The locking first frame 156 has a bore 158 alignable and indexable with any of the series of the second rod holes or apertures 154. A steel pin 160 may be passed into the bore 158 and secured to spring 162. An epoxy seal plug 164 seals the outer portion of bore 158.

It can be appreciated that a magnet 166 rubbed across the face of the first locking frame 156 will move steel pin 160 rearwardly to permit the second parallel rod 152 to pass into the first frame 156 to a particular location whereat the magnet is released and spring 162 urges steel pin 160 through one of the aligned holes 154 of the second parallel rod 152 that are aligned with bore 158.

Figure 12:
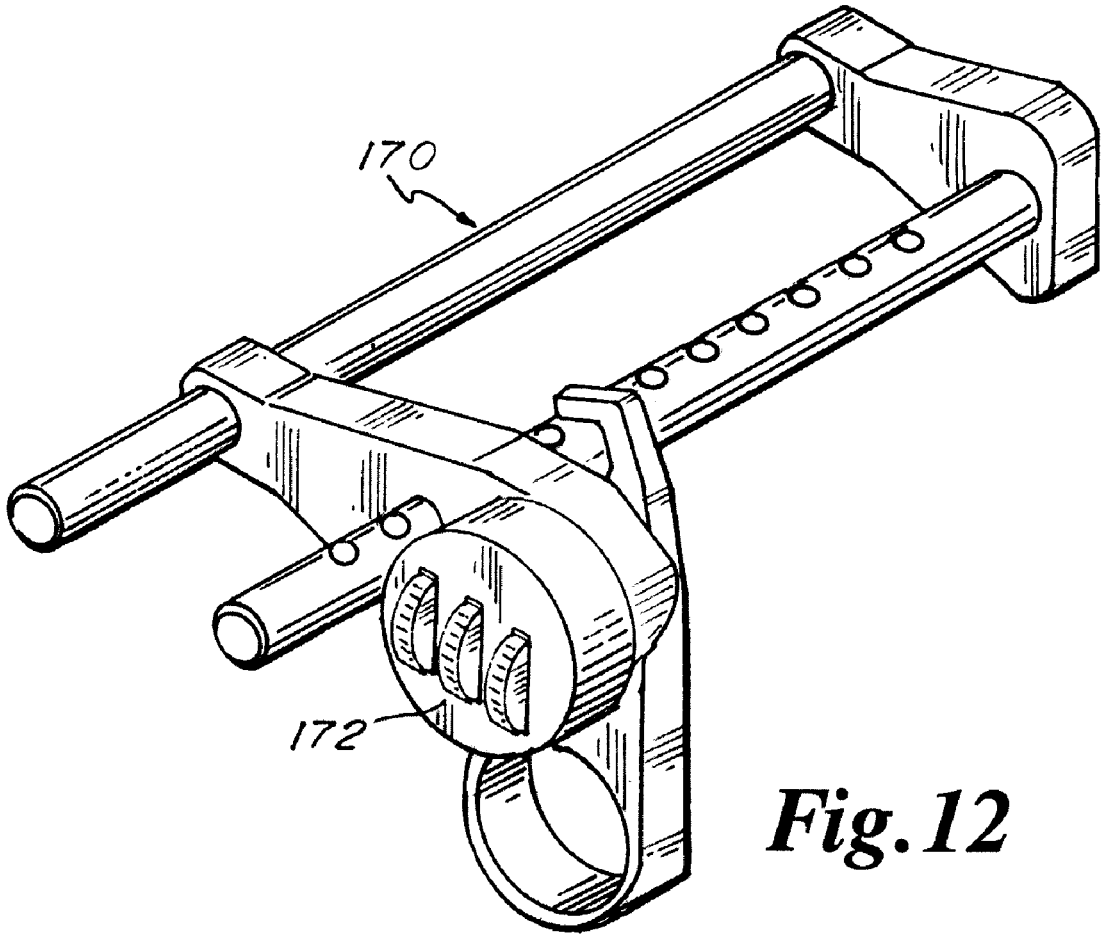
FIG. 12 is a perspective view of a third embodiment of the present invention with a tumbler combination wheel lock.

Referring to FIG. 12, a third embodiment of the adjustable archery bow lock 170 may be appreciated. The third embodiment lock 170 is substantially the same as previous locks 100 and 150 excepting that a tumbler combination wheel lock 172 is used to secure the first frame to the second frame.

Referring to FIGS. 13 through 18, a fourth embodiment of bow lock 200 may be understood. Generally, bow lock 200 is molded out of plastic and contains three key parts including the locking first frame 202, key 204 and second parallel frame 222 with first and second rods 228 and 236.

More specifically, key 204 has two laterally and opposing extending double flanges 205 with its body passing between first and second rods 228 and 236 when unlocking bow lock 200.

Locking first frame 202 includes its lock mechanism 206 which includes a movable biased latch 208 with an indexing pin 210 clearly shown in FIGS. 13, 15, 17 and 16. The first frame 202 has an anchor gripping ring 212 for receiving the cable guide 52 of a bow or for securement of a series of bows with locks 200 with a chain or securing lock cable. First frame 202 as a first rod aperture 216 and a second rod aperture 218 wherein the lock mechanisms 206 are located.

A second parallel frame 222 includes first and second parallel rods 228 and 236 with teeth or serrations 240.

In operation, the second parallel frame 222 with its first and second rods 228 and 236 capture bow string 30 and cables 40*a* and 40*b*. Alternatively, the first and second rods 228 and 236 may pass through a pulley or cam 42 or 44 which will prohibit their rotation and effectively lock the bow 10. In another alternative with a cross bow 60, the first and second rods 228 and 236 capture the bow string 62 and cable 64*a* and 64*b* or one of the pulleys or cams as showing in FIG. 18. Next the first locking frame with its first and second rod apertures 216 and 218 containing the lock mechanisms 206 are slid over the first and second rods 228 and 236 so that the teeth 240 mesh with the movable latch 208 and secure thereat with indexing pins 210. Once this is accomplished, the bow 10 or cross bow 60 is suitably locked and cannot be tested or dry fired.

Figure 13:
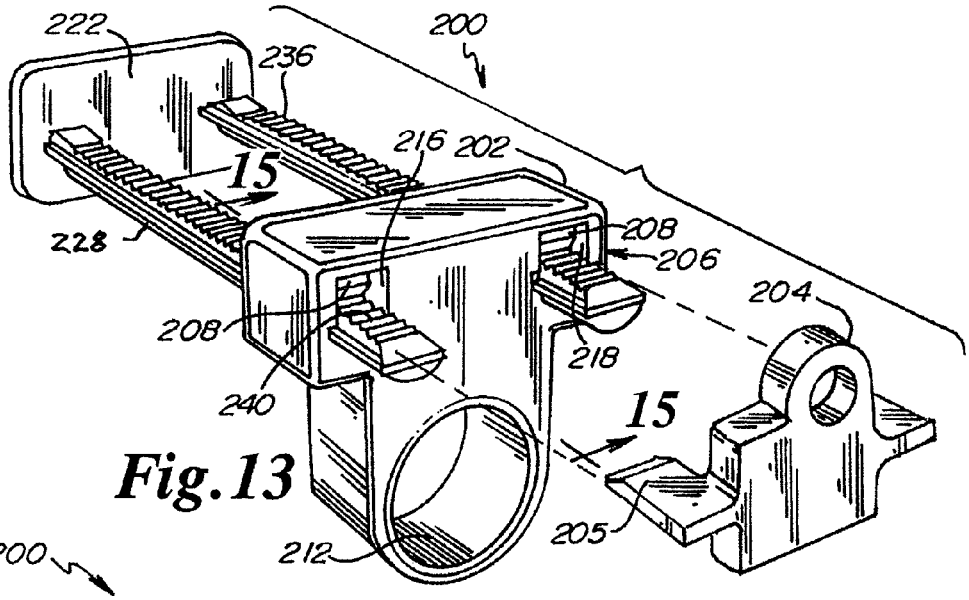
FIG. 13 is a perspective view of a fourth embodiment of the present invention suitably molded of plastic.
Figure 14:
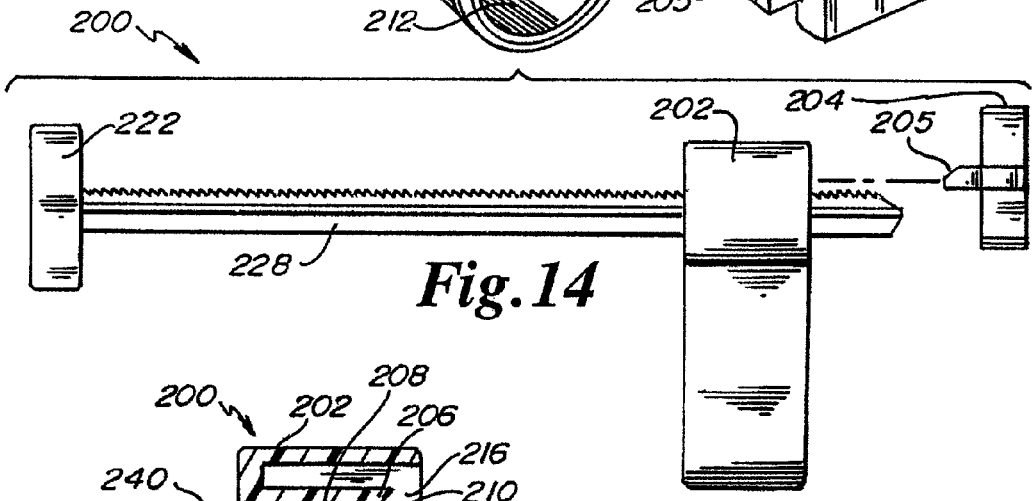
FIG. 14 is a side elevational view of the fourth embodiment.
Figure 15:
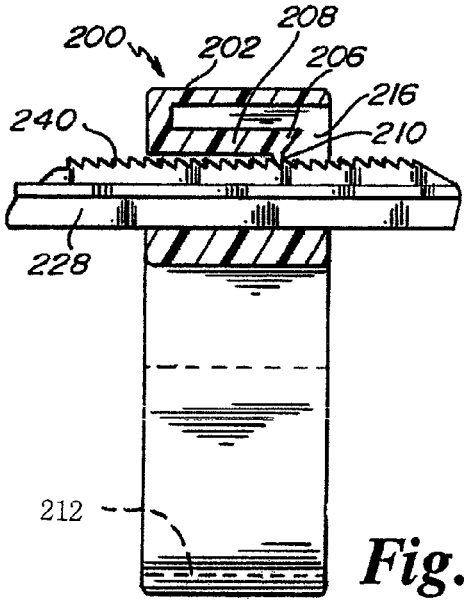
FIG. 15 is a cross sectional view along lines 15-15 of FIG. 13.
Figure 17:
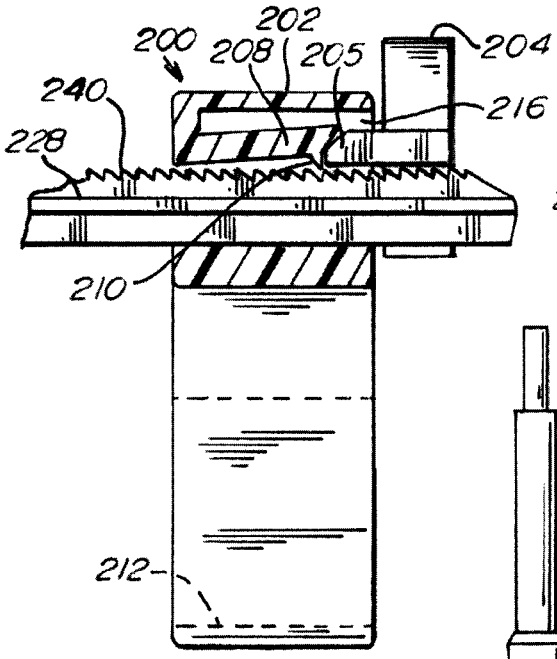
FIG. 17 is a cross sectional view similar to FIG. 15 with the key inserted.
Figure 16:
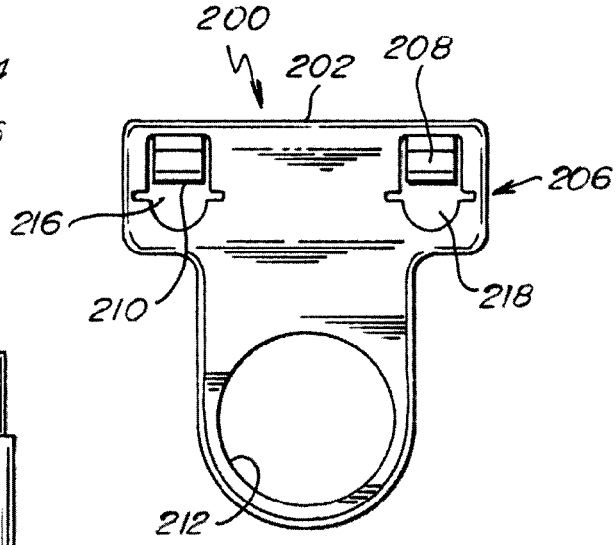
FIG. 16 is an elevational view of the locking first frame.
Figure 18:
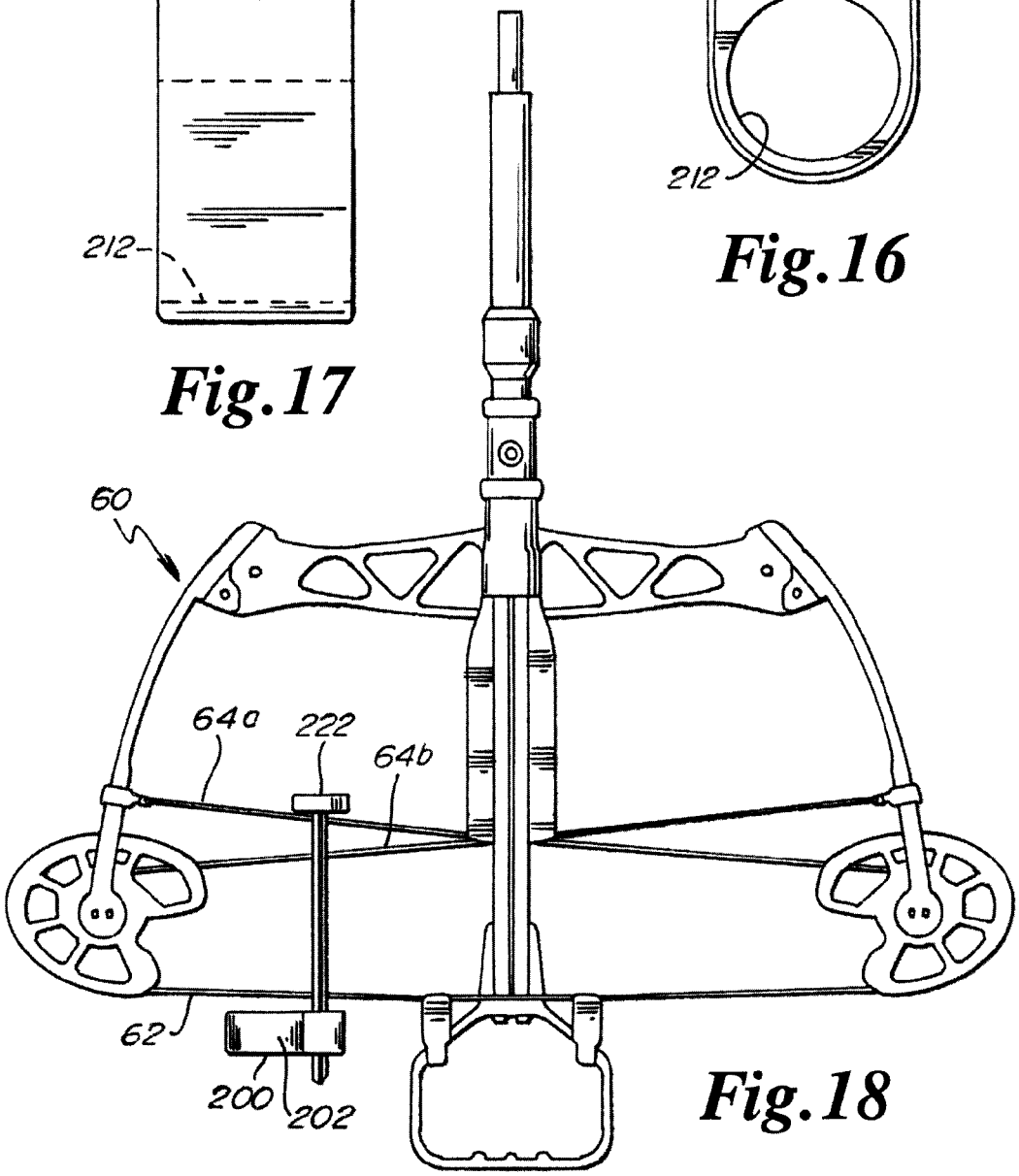
FIG. 18 is a top plan view of the fourth embodiment securing a cross bow.

To release the bow lock 200, the key 204 as shown in FIGS. 13 and 17 has its double flanges 205 slid into the apertures 216 and 218 as to lift the biased movable latch 208 so that the indexing pins 210 are out of engagement with the teeth 240 and simultaneously the first locking frame 202 may be separated from the second frame 222.

The invention is illustrated in the above embodiments. However, the full scope and breath of the invention is to be appreciated by the following claims as the above specification and figures are for illustrative purposes only.

What is claimed is:

1. An adjustable molded plastic archery bow lock for an archery bow with bow strings, or a limb with a cam or a pulley, comprising:

a) a locking first frame having a body removably attachable to the bow, said body further comprising an extension transverse to said body with transverse first and second rod receiving apertures therethrough;

b) a lock mechanism integral and one piece with the extension with a biased latch having a movable and securable locking index pin located within at least one of the rod receiving apertures;

c) a second frame parallel with the extension with transverse first and second rods parallel to each other, one of which rods has a series of aligned teeth any of which will lockably receive the locking index pin, the rods being adapted to capture and immobilize the bow strings, or the cam or the pulley with the limb, and to pass through the receiving apertures and secured thereat with the locking index pin engaging at least with one of the rods to prevent drawing or firing of the bow; and d) a key with a flange for insertion into the rod receiving aperture with the lock mechanism to lift the biased latch and index pin out of engagement with the locked rod.

2. The adjustable archery bow lock of claim 1, further comprising one of the frames having a transverse lock indexing ring to capture and surround a cable guide on the archery bow to be locked.

3. The adjustable archery bow lock of claim 1, wherein the rods pass through the first frame receiving apertures to adjustably lock the first and second frames together with variable adjustable distances between the frames.

4. An adjustable molded plastic archery bow lock for an archery bow with bow strings, or a limb with a cam or a pulley, comprising:

a) a locking first frame having a body removably attachable to the bow, said body further comprising an extension transverse to said body with transverse first and second rod receiving apertures therethrough;

b) a lock mechanism integral and one piece with the extension with a movable biased latch with an indexing pin located within at least one of the rod receiving apertures and a key with a flang for insertion into the rod receiving aperture with the lock mechanism to move the latch and the pin; and c) a second frame parallel to the extension with transverse first and second rods parallel to each other, one of which having a series of aligned teeth, the rods adapted to capture and immobilize the bow strings, or the cam or the pulley with the limb, and to pass through the receiving apertures to adjustably lock the first and second frames together with the locking index pin lockably secured to one of the aligned teeth to prevent drawing or firing of the bow.

5. The adjustable archery bow lock of claim 4, further comprising a lock indexing ring to capture and surround a cable guide on the archery bow to be locked.

6. An adjustable plastic molded archery bow lock for an archery bow with bow strings, or a limb with a cam or a pulley, comprising:

a) a locking first frame having a body removably attachable to the bow, said body further comprising an extension transverse to said body with transverse first and second rod receiving apertures therethrough;

b) a lock mechanism integral and one piece with en the extension with a movable biased and securable latch with a locking index pin located within at least one of the rod receiving apertures;

c) a second frame parallel to the extension with transverse first and second rods parallel to each other with teeth adapted to capture and immobilize the bow strings, or the cam or the pulley with the limb, and to pass through the receiving apertures and secured thereat with the locking index pin against the teeth to prevent drawing or firing of the bow; and d) a lock indexing ring on one of the frames to capture and surround a cable guide on the archery bow to be locked, to hold the bow lock in place on the bow.

* * * * *